US006039766A

United States Patent [19]

Mizuno et al.

[11] Patent Number: 6,039,766

[45] Date of Patent: Mar. 21, 2000

[54] CLEANING PROCESS FOR DRY CLEANING

[75] Inventors: Yuhei Mizuno, Fukui; Yoshihiro Kawamura, Sakai-gun; Shiro Kondo, Sabae, all of Japan

[73] Assignee: Nicca Chemical Co., Ltd., Fukui, Japan

[21] Appl. No.: 09/174,310

[22] Filed: Oct. 19, 1998

[30] Foreign Application Priority Data

Nov. 6, 1997 [JP] Japan ..... 9-304438

[51] Int. Cl.[7] ..... D06L 1/04; C11D 3/24; C11D 3/26

[52] U.S. Cl. ..... 8/142; 8/137; 510/285; 510/288; 510/289; 510/175; 134/42; 134/22.19

[58] Field of Search ..... 8/142, 137; 510/285, 510/288, 289, 175; 134/42, 22.19

[56] References Cited

U.S. PATENT DOCUMENTS 3,920,389 11/1975 Eanzel ..... 8/142
3,948,819 4/1976 Wilde ..... 510/254
5,004,825 4/1991 Yoshida et al. ..... 558/131

FOREIGN PATENT DOCUMENTS 1493944 6/1972 Germany .
6-136579 5/1994 Japan .
6-158531 6/1994 Japan .
9-49094 2/1997 Japan .

*Primary Examiner*—Alan Diamond
*Attorney, Agent, or Firm*—Young & Thompson

[57] ABSTRACT

A process for dry cleaning using a cleaning composition for dry cleaning which includes 1 to 90% by weight of a surfactant containing fluorine and 10 to 99% by weight of a fluorohydrocarbon solvent and/or an auxiliary solubilizing agent, the surfactant containing fluorine being a salt of a phosphoric acid ester of a polyoxyalkylenealkylsulfonamide ether containing fluorine.

4 Claims, No Drawings

CLEANING PROCESS FOR DRY CLEANING

BACKGROUND OF THE INVENTION

1. Field of the Invention

The present invention relates to a process for dry cleaning of fabrics comprising using a cleaning composition for dry cleaning. More particularly, the present invention relates to a process for dry cleaning comprising using a cleaning composition which shows an excellent cleaning property and property to prevent soiling of cleaned articles and provides a cleaned article with the antistatic property and softness.

2. Description of the Related Arts

Cloths and the like can be cleaned by wet cleaning which is a neutral cleaning using water, by laundry cleaning which is an alkaline cleaning, or by dry cleaning using a petroleum solvent, tetrachloroethylene, CFC-113, 1,1,1-trichloroethane, or a fluorine-containing solvent which is used in place of the restricted fluorine-containing solvents. The production of trichloroethane and the restricted fluorine-containing solvents was discontinued at the end of 1995, and solvents such as HCFC-225 and HCFC-141b are used as the solvent for dry cleaning in place of the restricted fluorine-containing solvents.

However, the use of these solvents is allowed within a limited period of time because of high coefficients of ozonosphere destruction and high coefficients of global warming although these solvents have low boiling points, can be dried rapidly and easily and give a relatively small degree of mechanical damage to cloths during drying. Moreover, HCFC-225 shows chemical attack to give damage to acrylic resins. A method cleaning which can remove soils without chemical damage to articles for cleaning is proposed in Japanese Patent Application Laid-Open No. Heisei 6(1994)-158531, in which a liquid prepared by adding a surfactant containing fluorine to a fluorocarbon liquid such as FC-51-14, FC-61-16 and FC-71-18 is used as the cleaning liquid. However, the fluorocarbon liquids show weak cleaning ability, and it is difficult to obtain satisfactory cleaning ability even when a surfactant containing fluorine is added.

Conventional cleaning compositions for dry cleaning contain a cationic or anionic surfactant having a hydrocarbon group as the lipophilic group and a nonionic surfactant as the main components and have the cleaning property and the property to prevent soiling of cleaned articles and provides cleaned articles with the antistatic property, softness and the antibacterial property. Therefore, it is not necessary that an additional surfactant is used. In recent years, fluorine-containing solvents of the so-called third generation which are fluorohydrocarbons having smaller coefficients of ozonosphere destruction and smaller coefficients of global warming are being used as the solvent for cleaning metal parts and electronic parts in place of the HCFC solvents. These solvents will be used also as the cleaning solvent for dry cleaning in place of the restricted fluorine-containing solvents. However, the fluorine-containing solvents of the third generation have considerably smaller KB values (kauri-butanol values) and show very small solubilizing ability. Therefore, surfactants having hydrocarbon groups which have heretofore been used in cleaning compositions for dry cleaning cannot be used for the fluorine-containing solvents of the third generation.

A cleaning composition which shows an excellent cleaning property and property to prevent soiling of cleaned articles, provides cleaned articles with the antistatic property and softness and can be used in combination with a fluorine-containing solvent of the third generation has been desired.

SUMMARY OF THE INVENTION

Accordingly, an object of the present invention is to provide a process for dry cleaning comprising the step of dry cleaning using a cleaning composition which does not adversely affect the properties required for a cleaning agent for dry cleaning such as the cleaning property, shows an excellent property to prevent soiling of cleaned articles, provides cleaned articles with the antistatic property and softness and can be used as an additive to fluorine-containing solvents of the third generation.

As the result of extensive studies by the present inventors to solve the above problems, it was found that a cleaning composition comprising a surfactant containing fluorine and having a specific structure and a fluorohydrocarbon solvent and/or an auxiliary solubilizing agent is soluble in fluorine-containing solvents of the third generation having a low KB value, such as alkoxyperfluoroalkanes such as methyl perfluorobutyl ether and ethyl perfluorobutyl ether, and exhibits an excellent cleaning property and property for preventing soiling of cleaned articles and provides cleaned articles with the antistatic property and softness. The present invention was completed on the basis of this knowledge.

Accordingly, the present invention provides:

(1) A process for dry cleaning comprising using a cleaning composition for dry cleaning which comprises 1 to 90% by weight of a surfactant containing fluorine and 10 to 99% by weight of a fluorohydrocarbon solvent and/or an auxiliary solubilizing agent, wherein the surfactant containing fluorine is a salt of a phosphoric acid ester of a polyoxyalkylenealkylsulfonamide ether containing fluorine which is represented by general formula [1]:

[1]

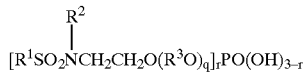

wherein $R^1$ represents a perfluoroalkyl group having 3 to 12 carbon atoms, $R^2$ represents an alkyl group having 1 to 5 carbon atoms, $R^3$ represents an alkylene group having 2 to 4 carbon atoms, q represents a number of 0 to 10, and r represents a number of 1 or 2;

(2) A process described in (1), wherein the salt of a phosphoric acid ester of a polyoxyalkylenealkylsulfonamide ether containing fluorine is a salt of said ester with a compound represented by general formula [2]:

[2]

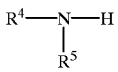

wherein $R^4$ and $R^5$ each represents hydrogen atom, an alkyl group having 1 to 12 carbon atoms, cyclohexyl group, benzyl group, or a hydroxyalkyl group having 1 to 4 carbon atoms, and $R^4$ and $R^5$ may be the same with or different from each other;

a diamine represented by general formula [3]:

[3]

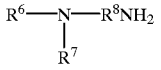

wherein $R^6$ and $R^7$ each represents hydrogen atom or an alkyl group having 1 to 6 carbon atoms, $R^6$ and $R^7$ may be the same with or different from each other, and $R^8$ represents an alkylene group having 1 to 10 carbon atoms;

a triamine represented by general formula [4]:

[4]

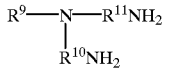

wherein $R^9$ represents hydrogen atom or an alkyl group having 1 to 4 carbon atoms, $R^{10}$ and $R^{11}$ represents an alkylene group having 2 to 6 carbon atoms, and $R^{10}$ and $R^{11}$ may be the same with or different from each other; or an adduct of an alkylene oxide with the amine, the diamine, or the triamine;

(3) A process described in (1) or (2), wherein the fluorohydrocarbon solvent is an alkoxyperfluoroalkane represented by general formula [5]:

$$C_nF_{2n+1}OC_mH_{2m+1} \quad [5]$$

wherein n represents a number of 3 or 4, and m represents a number of 1 to 3; and (4) A process described in (1), (2) or (3), wherein the auxiliary solubilizing agent is a solvent or a mixture of solvents selected from the group consisting of alcohol solvents, ether solvents which are adducts of alkylene oxides with alcohols, glycol solvents, hydrocarbon solvents and ketone solvents.

DESCRIPTION OF THE PREFERRED EMBODIMENTS

The cleaning composition for dry cleaning of the present invention is added and dissolved into a solvent for dry cleaning. The cleaning composition of the present invention is particularly advantageously used in combination with fluorine-containing solvents of the third generation.

The cleaning composition of the present invention comprises 1 to 90% by weight of a surfactant containing fluorine and 10 to 99% by weight of a fluorohydrocarbon solvent and/or an auxiliary solubilizing agent. Preferably, the cleaning composition comprises 5 to 70% by weight of a surfactant containing fluorine and 30 to 95% by weight of a fluorohydrocarbon solvent and/or an auxiliary solubilizing agent. When the content of the surfactant containing fluorine is less than 1% by weight, there is the possibility that the cleaning ability, the antistatic property and softness are not sufficiently exhibited. When the content of the surfactant containing fluorine exceeds 90% by weight, there is the possibility that viscosity, stability and easiness for use of the cleaning composition for dry cleaning are inferior.

In the cleaning composition for dry cleaning of the present invention, the surfactant containing fluorine is a salt of a phosphoric acid ester containing fluorine which is represented by general formula [1].

(1) A phosphoric acid ester of a polyoxyalkylenealkylsulfonamide ether containing fluorine which is represented by general formula [1]:

[1]

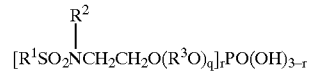

wherein $R^1$ represents a perfluoroalkyl group having 3 to 12 carbon atoms, preferably 6 to 8 carbon atoms, $R^2$ represents an alkyl group having 1 to 5 carbon atoms, preferably 1 to 3 carbon atoms, $R^3$ represents an alkylene group having 2 to 4 carbon atoms, preferably 2 or 3 carbon atoms, q represents a number of 0 to 10, preferably 1 to 5, and r represents a number of 1 or 2, preferably 1.

In the cleaning composition for dry cleaning of the present invention, it is preferable that the salt of a phosphoric acid ester of a polyoxyalkylenealkylsulfonamide ether containing fluorine is a salt of said ester with an amine represented by general formula [2], [3], or [4] or an adduct of an alkylene oxide with said amine.

(2) An amine represented by general formula [2]:

[2]

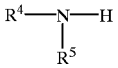

wherein $R^4$ and $R^5$ each represents hydrogen atom, an alkyl group having 1 to 12 carbon atoms, cyclohexyl group, benzyl group or a hydroxyalkyl group having 1 to 4 carbon atoms, and $R^4$ and $R^5$ may be the same with or different from each other. In general formula [2], it is preferable that at least one of $R^4$ and $R^5$ represents an alkyl group having 1 to 10 carbon atoms, cyclohexyl group, benzyl group, or a hydroxyalkyl group having 2 or 3 carbon atoms.

(3) A diamine represented by general formula [3]:

[3]

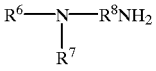

wherein $R^6$ and $R^7$ each represents hydrogen atom or an alkyl group having 1 to 6 carbon atoms, $R^6$ and $R^7$ may be the same with or different from each other, and $R^8$ represents an alkylene group having 1 to 10 carbon atoms. In general formula [3], it is preferable that $R^6$ and $R^7$ each represents hydrogen atom or an alkyl group having 1 or 2 carbon atoms.

(4) A triamine represented by general formula [4]:

[4]

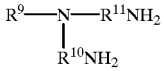

wherein $R^9$ represents hydrogen atom or an alkyl group having 1 to 4 carbon atoms, $R^{10}$ and $R^{11}$ represents an alkylene group having 2 to 6 carbon atoms, and $R^{10}$ and $R^{11}$ may be the same with or different from each other. In general formula [4], it is preferable that $R^9$ represents hydrogen atom or an alkyl group having 1 or 2 carbon atoms.

By the use of the surfactant containing fluorine which is the salt of the amine represented by general formula [2], [3],or [4] or an adduct of an alkylene oxide with the amine with the phosphoric acid ester containing fluorine which is represented by general formula [1], the cleaning composition for dry cleaning exhibits an enhanced cleaning property and property for preventing soiling of cleaned articles and provides cleaned articles with an excellent antistatic property and softness. Moreover, solubility of the cleaning composition for dry cleaning into a solvent for dry cleaning can be increased.

In the cleaning composition for dry cleaning, it is preferable that the fluorohydrocarbon solvent is an alkoxyperfluoroalkane represented by general formula [5]:

$$C_nF_{2n+1}OC_mH_{2m+1} \quad [5]$$

wherein n represents a number of 3 or 4, and m represents a number of 1 to 3.

In the cleaning composition for dry cleaning of the present invention, it is preferable that the auxiliary solubilizing agent is an alcohol solvent such as methanol, ethanol and isopropanol, an ether solvent which is an adduct of an alkylene oxide with an alcohol, a glycol solvent, a hydrocarbon solvent, or a ketone solvent. The auxiliary solubilizing agent can be used singly or as a mixture of two or more agents. In the composition of the present invention, the cleaning composition for dry cleaning can have a decreased viscosity and an increased stability when the auxiliary solubilizing agent is comprised. Among the auxiliary solubilizing agents, 3-methyl-3-methoxybutanol which has a low toxicity and a relatively high flash point is preferably used.

In the cleaning composition for dry cleaning of the present invention, where necessary, nonionic surfactants, such as polyoxypropylene(7mol) perfluoroalkyl ether, polyoxyethylene(2 mol) nonylphenyl ether, polyoxyethylene(3 mol) lauryl ether, silicone oils and rust preventives may suitably be added.

To summarize the advantages obtained by the present invention, when dry cleaning is carried out using a solution obtained by adding the cleaning composition for dry cleaning of the present invention to an alkoxyperfluoroalkane, i.e., a so-called dry cleaning solvent of the third generation, the excellent cleaning property and the property of preventing soiling of cleaned articles can be obtained, and the cleaned article is provided with the antistatic property and softness.

EXAMPLES

The present invention is described more specifically with reference to examples in the following. However, the present invention is not limited to the examples.

In the examples and the comparative examples, evaluation of the properties was conducted in accordance with the following methods.

(1) Degree of Cleaning and Degree of Soiling of Cleaned Articles

In a 500 ml stainless pot, 0.3% by volume of a cleaning composition was dissolved into 100 ml of methyl perfluorobutyl ether (solvent 1) or ethyl perfluorobutyl ether (solvent 2) to prepare a cleaning liquid. White cloths of a No. 40 cotton broad cloth, a wool muslin, an acrylic knit fabric and a polyester jersey which had a dimension of 4 cm×8 cm and soiled cloths which were prepared from the white cloths in accordance with the method of Japanese Association of Oil Chemistry and had a dimension of 4 cm×8 cm were cleaned with the above cleaning liquid at 20° C. for 10 minutes using ROUNDA-O-METER (manufactured by TAIEI KAGAKUSEIKI SEISAKUSHO Co., Ltd.; L-20). In the method of Japanese Association of Oil Chemistry, cloths were treated by patting in a soiling bath prepared by dissolving 1 g of hardened beef tallow, 3 g of liquid paraffin and 0.5 g of carbon black in 800 g of carbon tetrachloride, and the reflectivity was adjusted to about 30%. The liquid was removed from the soiled cloths using a centrifugal dehydrator (manufactured by EIKO SANGYO Co., Ltd.; H120A) for 1 minute, and the obtained cloths were left standing for 60 minutes for drying. The reflectivity at 550 nm of the white cloths and the soiled cloths before and after the cleaning was measured using a calorimeter (manufactured by MURAKAMI SHIKISAIGIJUTU KENKYUSHO Co., Ltd.; CLEANMASTER CM-53D),, and the degree of cleaning and the degree of soiling of cleaned articles were calculated in accordance with the following equations:

$$\text{degree of cleaning } (\%)=\{(S_2-S_1)/(W_1-S_1)\}\times 100$$

$$\text{degree of soiling of cleaned articles } (\%)=\{(W_1-W_2)/W_1\}\times 100$$

wherein:

$S_1$: the reflectivity of a soiled cloth before the cleaning $S_2$: the reflectivity of a soiled cloth after the cleaning $W_1$: the reflectivity of a white cloth before the soiling and the cleaning $W_2$: the reflectivity of a white cloth after the cleaning.

The cotton broad cloth, the wool muslin, the acrylic knit fabric and the polyester jersey are hereinafter abbreviated as cotton, wool, acrylic and polyester, respectively.

(2) Antistatic property

A cleaning composition for dry cleaning in an amount of 0.2% by volume was dissolved into 10 liters of ethyl perfluorobutyl ether. Trousers for men (100% wool) and a skirt for women (100% polyester) which were soiled after use were cut into halves to prepare test cloths. The test cloths were cleaned with the above solution containing the cleaning composition using a dry cleaning tester (manufactured by TAIEI KAGAKUSEIKI SEISAKUSHO Co., Ltd.; TESTER DC-2) at a room temperature for 15 minutes. The liquid was removed from the cleaned cloths using a centrifugal dehydrator for 1 minute. The test cloths were then dried in a drier with circulation of air heated at 50° C. for 10 minutes. The electric resistance at the surface of the test cloths was measured immediately after being taken out of the drier using an electric insulation-resistance tester (manufactured by TOA DENPA Co., Ltd.; SM-8210).

(3) Softness

After the test cloths used for the evaluation of the antistatic property were left standing in a room, the softness was evaluated by the feel of touch and classified into the following five grades:

1: rough and hard

2: slightly hard

3: soft

4: considerably soft

5: very soft

Softer the cloth, the less the formation of lines and the better the finishing and the feel in use.

(4) Cleaning Property

After being used for the evaluation of the softness, soiled portions of the test cloths and the original cloths were compared with each other by visual observation.

Chemical formulae of the compounds used in the Examples and Comparative Examples are as follows:

(1) Cyclohexyldipropanolamine salt of N-ethylperfluorooctylsulfonamidoethyl phosphate

[6]

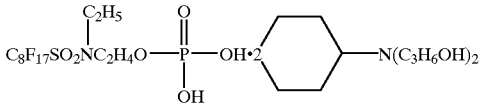

(2) N,N-diethyl-N',N'-dihydroxypropyl-1,3-propyldiamine salt of N-ethylperfluorooctylsulfonamidoethyl phosphate

[7]

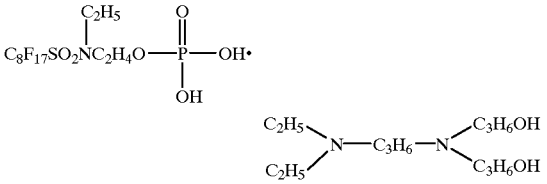

(3) Octyldihydroxyethylamine salt of N-ethylperfluorooctylsulfonamidopropoxyethyl phosphate

[8]

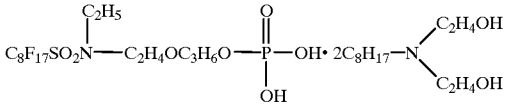

(4) N,N-dimethyl-1,2-ethanediamine salt of N-ethylperfluorooctylsulfonamidoethyl phosphate

[9]

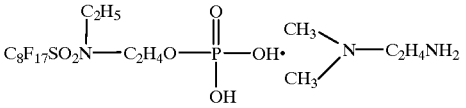

(5) Polyoxypropylene(7 mol) 2-perfluorohexylethyl ether $C_6F_{13}C_2H_4O(C_3H_6O)_7H$ [10]

(6) Polyoxyethylene(3 mol) lauryl ether $C_{12}H_{25}O(C_2H_4O)_3H$ [11]

(7) Triethanolamine salt of dodecylbenzenesulfonic acid

[12]

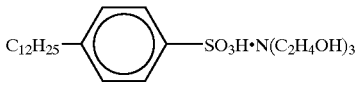

(8) Methylbis(dihydroxypropylaminomethyl)amine salt of N-ethylperfluorooctylsulfonamidoethoxyethoxyethyl phosphate

[13]

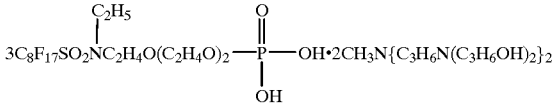

(9) Polyoxyethylene(2 mol) 2-ethylhexyl ether

[14]

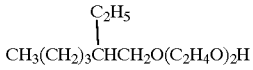

(10) Polyoxyethylene(2 mol) nonylphenyl ether

[15]

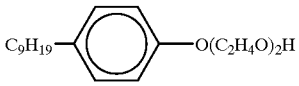

Example 1

Cyclohexyldipropanolamine salt of N-ethylperfluorooctylsulfonamidoethyl phosphate expressed by formula [6] in an amount of 30 parts by weight, 20 parts by weight of 3-methyl-3-methoxybutanol and 50 parts by weight of ethyl perfluorobutyl ether were mixed together to prepare a cleaning composition for dry cleaning, and the degree of cleaning and the degree of soiling of cleaned articles were measured after cleaning using a cleaning liquid containing the prepared cleaning composition for dry cleaning.

When solvent 1 was used, the degree of cleaning was 12% for cotton, 14% for wool, 7% for acrylic and 7% for polyester. The degree of soiling of cleaned articles was 3.8% for cotton, 4.8% for wool, 6.6% for acrylic and 9.0% for polyester.

When solvent 2 was used, the degree of cleaning was 15% for cotton, 24% for wool, 11% for acrylic and 11% for polyester. The degree of soiling of cleaned articles was 4.0% for cotton, 4.3% for wool, 9.8% for acrylic and 17.6% for polyester.

Example 2

N,N-diethyl-N',N'-dihydroxypropyl-1,3-propyldiamine salt of N-ethylperfluorooctylsulfonamidoethyl phosphate expressed by formula [7] in an amount of 10 parts by weight, 50 parts by weight of 3-methyl-3-methoxybutanol and 40 parts by weight of ethyl perfluorobutyl ether were mixed together to prepare a cleaning composition for dry cleaning, and the degree of cleaning and the degree of soiling of cleaned articles were measured after cleaning using a cleaning liquid containing the prepared cleaning composition for dry cleaning.

When solvent 1 was used, the degree of cleaning was 12% for cotton, 12% for wool, 7% for acrylic and 7% for polyester. The degree of soiling of cleaned articles was 3.9% for cotton, 5% for wool, 8.1% for acrylic and 11.8% for polyester.

When solvent 2 was used, the degree of cleaning was 15% for cotton, 23% for wool, 10% for acrylic and 10% for polyester. The degree of soiling of cleaned articles was 4.7% for cotton, 5.1% for wool, 12.5% for acrylic and 18% for polyester.

Example 3

Octyldihydroxyethylamine salt of N-ethylperfluorooctylsulfonamidopropoxyethyl phosphate expressed by formula [8] in an amount of 70 parts by weight and 30 parts by weight of 3-methyl-3-methoxybutanol were mixed together to prepare a cleaning composition for dry cleaning, and the degree of cleaning and the degree of soiling of cleaned articles were measured after cleaning using a cleaning liquid containing the prepared cleaning composition for dry cleaning.

When solvent 1 was used, the degree of cleaning was 11% for cotton, 13% for wool, 7% for acrylic and 7% for polyester. The degree of soiling of cleaned articles was 3% for cotton, 4.8% for wool, 6.8% for acrylic and 9.5% for polyester.

When solvent 2 was used, the degree of cleaning was 14% for cotton, 23% for wool, 11% for acrylic and 11% for polyester. The degree of soiling of cleaned articles was 3.9% for cotton, 4.1% for wool, 11.2% for acrylic and 17.6% for polyester.

Example 4

N,N-dimethyl-1,2-ethanediamine salt of N-ethylperfluorooctylsulfonamidoethyl phosphate expressed by formula [9] in an amount of 30 parts by weight, 40 parts by weight of 3-methyl-3-methoxybutanol, and 30 parts by weight of ethyl perfluorobutyl ether were mixed together to prepare a cleaning composition for dry cleaning, and the degree of cleaning and the degree of soiling of cleaned articles were measured after cleaning using a cleaning liquid containing the prepared cleaning composition for dry cleaning.

When solvent 1 was used, the degree of cleaning was 12% for cotton, 12% for wool, 6% for acrylic and 7% for polyester. The degree of soiling of cleaned articles was 3.5% for cotton, 4.5% for wool, 8.2% for acrylic and 10.3% for polyester.

When solvent 2 was used, the degree of cleaning was 14% for cotton, 22% for wool, 9% for acrylic and 9% for polyester. The degree of soiling of cleaned articles was 4.5% for cotton, 4.3% for wool, 12.8% for acrylic and 18.7% for polyester.

Comparative Example 1

Polyoxypropylene(7 mol) 2-perfluorohexylethyl ether expressed by formula [10] in an amount of 50 parts by weight and 50 parts by weight of 3-methyl-3-methoxybutanol were mixed together to prepare a cleaning composition for dry cleaning, and the degree of cleaning and the degree of soiling of cleaned articles were measured after cleaning using a cleaning liquid containing the prepared cleaning composition for dry cleaning.

When solvent 1 was used, the degree of cleaning was 9% for cotton, 10% for wool, 4% for acrylic and 4% for polyester. The degree of soiling of cleaned articles was 6.2% for cotton, 6.3% for wool, 10.9% for acrylic and 17.3% for polyester.

When solvent 2 was used, the degree of cleaning was 12% for cotton, 20% for wool, 8% for acrylic and 8% for polyester. The degree of soiling of cleaned articles was 6.9% for cotton, 5.6% for wool, 17.1% for acrylic and 24.3% for polyester.

Comparative Example 2

Polyoxyethylene(3 mol) lauryl ether expressed by formula [11] in an amount of 30 parts by weight and 70 parts by weight of 3-methyl-3-methoxybutanol were mixed together to prepare a cleaning composition for dry cleaning, and the degree of cleaning and the degree of soiling of cleaned articles were measured after cleaning using a cleaning liquid containing the prepared cleaning composition for dry cleaning.

When solvent 1 was used, the degree of cleaning was 8% for cotton, 10% for wool, 5% for acrylic and 5% for polyester. The degree of soiling of cleaned articles was 6.2% for cotton, 5.4% for wool, 10.7% for acrylic and 16.6% for polyester.

When solvent 2 was used, the degree of cleaning was 11% for cotton, 20% for wool, 7% for acrylic and 7% for polyester. The degree of soiling of cleaned articles was 7.5% for cotton, 6.0% for wool, 16.3% for acrylic and 23.5% for polyester.

Comparative Example 3

Triethanolamine salt of dodecylbenzenesulfonic acid expressed by formula [12] in an amount of 20 parts by weight, 30 parts by weight of 3-methyl-3-methoxybutanol, and 50 parts by weight of ethyl perfluorobutyl ether were mixed together to prepare a cleaning composition for dry cleaning, and cleaning using a cleaning liquid containing the prepared cleaning composition and measurement of the degree of cleaning and the degree of soiling of cleaned articles were attempted.

However, the prepared cleaning composition for dry cleaning was insoluble in solvent 1 (methyl perfluorobutyl ether) and solvent 2 (ethyl perfluorobutyl ether). Therefore, the cleaning tests could not be made.

Comparative Example 4

The degree of cleaning and the degree of soiling of cleaned articles were measured after cleaning using a solvent alone without adding a cleaning composition for dry cleaning.

When solvent 1 was used, the degree of cleaning was 8% for cotton, 9% for wool, 4% for acrylic and 4% for polyester. The degree of soiling of cleaned articles was 6.7% for cotton, 6.1% for wool, 12.5% for acrylic and 19.3% for polyester.

When solvent 2 was used, the degree of cleaning was 10% for cotton, 19% for wool, 7% for acrylic and 7% for polyester. The degree of soiling of cleaned articles was 7.1% for cotton, 6.8% for wool, 18.1% for acrylic and 25.6% for polyester.

The formulations of the cleaning compositions used in Examples 1 to 4 and Comparative Examples 1 to 3 are shown in Table 1. The results of the measurements of the degree of cleaning and the degree of soiling of cleaned articles are shown in Table 2.

TABLE 1

| | Example | | | | Comparative Example | | |
|---|---|---|---|---|---|---|---|
| | 1 | 2 | 3 | 4 | 1 | 2 | 3 |
| Formulation (parts by weight) | | | | | | | |
| surfactant containing fluorine | | | | | | | |
| compound of formula [6] | 30 | — | — | — | — | — | — |
| compound of formula [7] | — | 10 | — | — | — | — | — |

TABLE 1-continued

| | Example | | | | Comparative Example | | |
|---|---|---|---|---|---|---|---|
| | 1 | 2 | 3 | 4 | 1 | 2 | 3 |
| compound of formula [8] | — | — | 70 | — | — | — | — |
| compound of formula [9] | — | — | — | 30 | — | — | — |
| surfactant | | | | | | | |
| compound of formula [10] | — | — | — | — | 50 | — | — |
| compound of formula [11] | — | — | — | — | — | 30 | — |
| compound of formula [12] | — | — | — | — | — | — | 20 |
| auxiliary solubilizing agent 3-methyl-3-methoxybutanol | 40 | 50 | 30 | 40 | 50 | 70 | 30 |
| fluorohydrocarbon solvent ethyl perfluorobutyl ether | 30 | 40 | — | 30 | — | — | 50 |

TABLE 2

| | Example | | | | Comparative Example | | | |
|---|---|---|---|---|---|---|---|---|
| | 1 | 2 | 3 | 4 | 1 | 2 | 3 | 4 |
| Solvent 1 | | | | | | | | |
| degree of cleaning (%) | | | | | | | | |
| cotton | 11 | 12 | 11 | 12 | 9 | 8 | — | 8 |
| wool | 13 | 12 | 13 | 12 | 10 | 10 | — | 9 |
| acrylic | 6 | 7 | 7 | 6 | 4 | 5 | — | 4 |
| polyester | 8 | 7 | 7 | 7 | 4 | 5 | — | 4 |
| degree of soiling of cleaned articles (%) | | | | | | | | |
| cotton | 4.1 | 3.9 | 3.0 | 3.5 | 6.2 | 6.2 | — | 6.7 |
| wool | 4.0 | 5.0 | 4.8 | 4.5 | 6.3 | 5.4 | — | 6.1 |
| acrylic | 7.3 | 8.1 | 6.8 | 8.2 | 10.9 | 10.7 | — | 12.5 |
| polyester | 12.2 | 11.8 | 9.5 | 10.3 | 17.3 | 16.6 | — | 19.3 |
| Solvent 2 | | | | | | | | |
| degree of cleaning (%) | | | | | | | | |
| cotton | 14 | 15 | 14 | 14 | 12 | 11 | — | 10 |
| wool | 23 | 23 | 23 | 22 | 20 | 20 | — | 19 |
| acrylic | 10 | 10 | 11 | 9 | 8 | 7 | — | 7 |
| polyester | 11 | 10 | 11 | 9 | 8 | 7 | — | 7 |
| degree of soiling of cleaned articles (%) | | | | | | | | |
| cotton | 5.4 | 4.7 | 3.9 | 4.5 | 6.9 | 7.5 | — | 7.1 |
| wool | 5.2 | 5.1 | 4.1 | 4.3 | 5.6 | 6.0 | — | 6.8 |
| acrylic | 10.7 | 12.5 | 11.2 | 12.8 | 17.1 | 16.3 | — | 25.6 |
| polyester | 15.3 | 18.0 | 17.6 | 18.7 | 24.3 | 23.5 | — | 25.6 |

When the results obtained by using the same fiber material and the same solvent shown in Table 2 are compared, it is understood that, with respect to the degree of cleaning, the results obtained in Examples in which the cleaning composition for dry cleaning of the present invention were used were better by about 3% than the results obtained in Comparative Examples in which conventional cleaning compositions for dry cleaning were used. Thus, the cleaning composition for dry cleaning of the present invention has a superior cleaning property. It is also understood that, with respect to the degree of soiling of cleaned articles, the results obtained in Examples in which the cleaning composition for dry cleaning of the present invention were used were better by 1 to 8% than the results obtained in Comparative Examples in which conventional cleaning compositions for dry cleaning were used. Thus, the cleaning composition for dry cleaning of the present invention has a superior property for preventing soiling of cleaned articles.

Example 5

Methylbis(dihydroxypropylaminopropyl)amine salt of N-ethylperfluorooctylsulfonamidoethoxyethoxyethyl phosphate expressed by formula [13] in an amount of 30 parts by weight, 60 parts by weight of 3-methyl-3-methoxybutanol, and 10 parts by weight of isopropyl alcohol were mixed together to prepare a cleaning composition for dry cleaning.

The antistatic property was evaluated using a cleaning liquid containing the prepared cleaning composition for dry cleaning, and the electric resistance was found to be $4\times10^{12}$ Ω with trousers and $2\times10^{11}$ Ω with a skirt. The softness was 4 with trousers and 4 with a skirt. Soils on the trousers and the skirt which were found before cleaning were almost completely removed by the cleaning.

Comparative Example 5

Polyoxyethylene(2 mol) 2-ethylhexyl ether expressed by formula [14] in an amount of 15 parts by weight, 15 parts by weight of polyoxyethylene(2 mol) nonylphenyl ether expressed by formula [15], and 70 parts by weight of isopropyl alcohol were mixed together to prepare a cleaning composition for dry cleaning.

The antistatic property was evaluated using a cleaning liquid containing the prepared cleaning composition for dry cleaning, and the electric resistance was found to be $2\times10^{13}$ Ω with trousers and $10^{14}$ Ω or more with a skirt. The softness was 3 with trousers and 3 with a skirt. Soils on the trousers and the skirt which were found before cleaning mostly remained after the cleaning.

The results obtained in Example 5 and Comparative Example 5 are shown in Table 3.

TABLE 3

| | Example 5 | Comparative Example 5 |
|---|---|---|
| Antistatic property (electric resistance, Ω) | | |
| trousers | $4 \times 10^{12}$ | $2 \times 10^{13}$ |
| skirt | $2 \times 10^{11}$ | $>10^{14}$ |
| Softness | | |
| trousers | 4 | 3 |
| skirt | 4 | 3 |
| Cleaning property | | |
| trousers | soils almost completely removed | most of soils remained |
| skirt | soils almost completely removed | most of soils remained |

When the cleaning composition for dry cleaning used in Example 5 which contained a salt of a propylene oxide adduct to a triamine represented by general formula [4] with an N-alkylperfluoroalkylsulfonamidoalkylpolyoxyalkylene phosphate represented by general formula [1] was dissolved into ethyl perfluorobutyl ether used as the solvent in an amount of 0.2% by volume and the obtained solution was used for dry cleaning, the cleaned trousers and skirt showed an excellent antistatic property, softness and cleaning property.

In contrast, when the hydrocarbon cleaning composition used in Comparative Example 5 was dissolved into ethyl perfluorobutyl ether used as the solvent in an amount of 0.2% by volume and the obtained solution was used for dry cleaning, the cleaned trousers and skirt showed an inferior antistatic property and harder feel of touch. This solution showed an inferior cleaning property.

What is claimed is:

1. A process for dry cleaning fabric, said process comprising the step of cleaning fabric by applying an effective amount of a cleaning composition for dry cleaning which comprises 1 to 90% by weight of a surfactant containing fluorine and 10 to 99% by weight of a fluorohydrocarbon solvent and/or an auxiliary solubilizing agent, wherein the surfactant containing fluorine is a salt of a phosphoric acid ester of a polyoxyalkylenealkylsulfonamide ether containing fluorine which is represented by general formula (1):

$$\{R^1SO_2\overset{\overset{\displaystyle R^2}{|}}{N}CH_2CH_2O(R^3O)_q\}_rPO(OH)_{3-r} \quad (1)$$

wherein $R^1$ represents a perfluoroalkyl group having 3 to 12 carbon atoms, $R^2$ represents an alkyl group having 1 to 5 carbon atoms, $R^3$ represents an alkylene group having 2 to 4 carbon atoms, q represents a number of 0 to 10, and r represents a number of 1 or 2, wherein said step of cleaning with a composition which includes the fluorohydrocarbon solvent includes the further step of providing an alkoxyperfluoroalkane represented by general formula (5):

$$C_nF_{2n+1}OC_mH_{2m+1} \quad (5)$$

wherein n represents a number of 3 or 4, and m represents a number of 1 to 3.

2. A process according to claim 1, wherein said step of cleaning with a composition which includes the auxiliary solubilizing agent includes the further step of providing a solvent or a mixture of solvents selected from the group consisting of alcohol solvents, ether solvents which are adducts of alkylene oxides with alcohols, glycol solvents, hydrocarbon solvents and ketone solvents.

3. A process for dry cleaning fabric, said process comprising the step of cleaning fabric by applying an effective amount of a cleaning composition for dry cleaning which comprises 1 to 90% by weight of a surfactant containing fluorine and 10 to 99% by weight of a fluorohydrocarbon solvent and/or an auxiliary solubilizing agent, wherein the surfactant containing fluorine is a salt of a phosphoric acid ester of a polyoxyalkylenealkylsulfonamide ether containing fluorine which is represented by general formula (1):

$$\{R^1SO_2\overset{\overset{\displaystyle R^2}{|}}{N}CH_2CH_2O(R^3O)_q\}_rPO(OH)_{3-r} \quad (1)$$

wherein $R^1$ represents a perfluoroalkyl group having 3 to 12 carbon atoms, $R^2$ represents an alkyl group having 1 to 5 carbon atoms, $R^3$ represents an alkylene group having 2 to 4 carbon atoms, q represents a number of 0 to 10, and r represents a number of 1 or 2, wherein said step of cleaning with a composition which includes the salt of a phosphoric acid ester of polyoxyalkylenealkylsulfonamide ether containing fluorine includes the further step of providing a salt of said ester with a first compound represented by general formula (2):

$$R^4-\underset{\underset{\displaystyle R^5}{|}}{N}-H \quad [2]$$

wherein $R^4$ and $R^5$ each represents a hydrogen atom, an alkyl group having 1 to 12 carbon atoms, cyclohexyl group, benzyl group or a hydroxyalkyl group having 1 to 4 carbon atoms, and $R^4$ and $R^5$ being the same or different from each other;

a diamine represented by general formula (3):

$$R^6-\underset{\underset{\displaystyle R^7}{|}}{N}-R^8NH_2 \quad (3)$$

wherein $R^6$ and $R^7$ each represents a hydrogen atom or an alkyl group having 1 to 6 carbon atoms, $R^6$ and $R^7$ being the same with or different from each other, and $R^8$ represents an alkylene group having 1 to 10 carbon atoms; a triamine represented by general formula (4):

$$R^9-\underset{\underset{\displaystyle R^{10}NH_2}{|}}{N}-R^{11}NH_2 \quad (4)$$

wherein $R^9$ represents a hydrogen atom or an alkyl group having 1 to 4 carbon atoms, $R^{10}$ and $R^{11}$ each represents an alkylene group having 2 to 6 carbon atoms, and $R^{10}$ and $R^{11}$ being the same or different from each other; or an adduct of an alkylene oxide with the first compound, the diamine, or the triamine, wherein said step of cleaning with a composition which includes the fluorohydrocarbon solvent includes the further step of providing an alkoxyperfluoroalkane represented by general formula (5):

$$C_nF_{2n+1}OC_mH_{2m+1} \quad (5)$$

wherein n represents a number of 3 or 4, and m represents a number of 1 to 3.

4. A process according to claim 3, wherein said step of cleaning with a composition which includes the auxiliary solubilizing agent includes the further step of providing a solvent or a mixture of solvents selected from the group consisting of alcohol solvents, ether solvents which are adducts of alkylene oxides with alcohols, glycol solvents, hydrocarbon solvents and ketone solvents.

* * * * *